United States Patent [19]

Frenzel

[11] 4,285,115

[45] Aug. 25, 1981

[54] METHOD OF MANUFACTURING RAILWAY SLEEPERS

[75] Inventor: Jürgen Frenzel, Freden, Fed. Rep. of Germany

[73] Assignee: ARBED, Luxembourg, Luxembourg

[21] Appl. No.: 44,476

[22] Filed: Jun. 1, 1979

Related U.S. Application Data

[63] Continuation-in-part of Ser. No. 870,883, Jan. 20, 1978, abandoned.

[30] Foreign Application Priority Data

Jan. 20, 1977 [AT] Austria ..... 321/77
Nov. 18, 1977 [DE] Fed. Rep. of Germany ..... 2751531

[51] Int. Cl.[3] ..... B23P 3/00; B23P 19/04

[52] U.S. Cl. ..... 29/460; 29/155 R; 29/463; 228/173 E; 228/173 F; 228/182

[58] Field of Search ..... 29/460, 155 R, 463; 228/173 E, 173 F, 182; 238/28, 44, 65

[56] References Cited

U.S. PATENT DOCUMENTS

| | | | |
|---|---|---|---|
| 830,287 | 9/1906 | Benjamin | 238/44 |
| 1,711,186 | 4/1929 | Tilley | 238/65 X |
| 2,902,753 | 9/1959 | Schilberg | 29/463 X |
| 3,200,026 | 8/1965 | Brown | 29/460 X |
| 3,400,446 | 9/1968 | Yulkowski | 29/463 |

*Primary Examiner*—Charlie T. Moon
*Attorney, Agent, or Firm*—Karl F. Ross

[57] ABSTRACT

A multiplicity of step-shaped sleepers or ties each having two straight end segments interconnected by a middle portion inclined at obtuse angles with respect to the end segments are each joined at their respective end segments to two adjacent sleepers by means of rib plates to form a zig-zag sleeper network underlying a pair of parallel spaced-apart rails in a railway roadbed assembly. The sleepers are formed from I-beam profiles; a plurality of channel profiles extending parallel to the rails below the sleeper network are connected to the rib plates by bolts traversing the sleepers, the channels being embedded in the ground or in a concrete track bed to prevent lateral displacement of the railway assembly. A method of forming Y-shaped ties includes the bending of I-beam profiles in a press die assembly, welding the profiles together and filling interbeam spaces with a weight-increasing corrosion-retarding material such as concrete.

3 Claims, 13 Drawing Figures

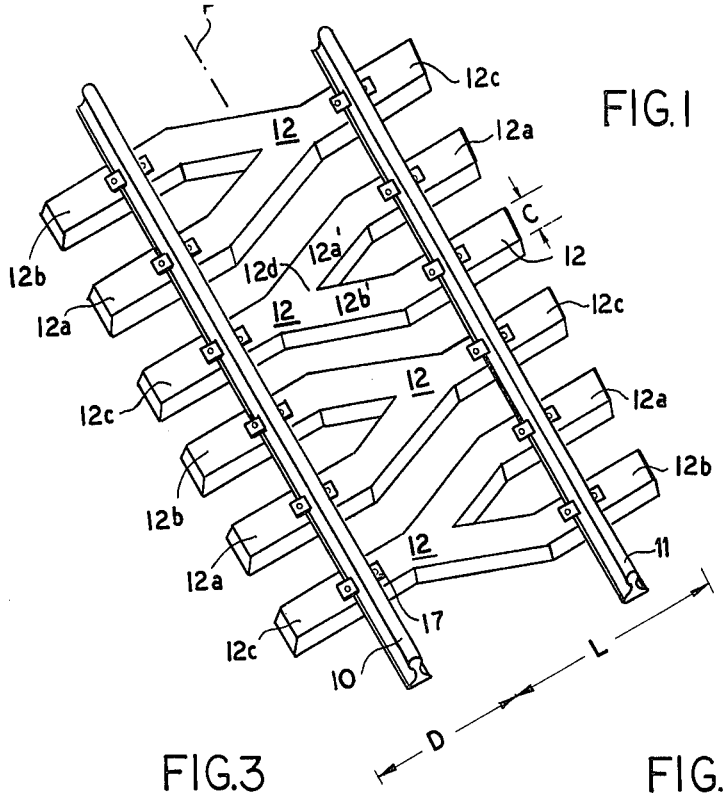
FIG.1
FIG.3
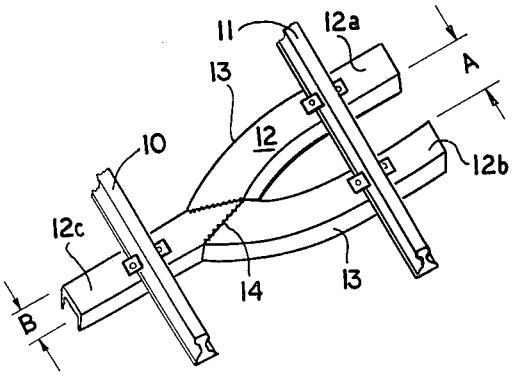
FIG.2
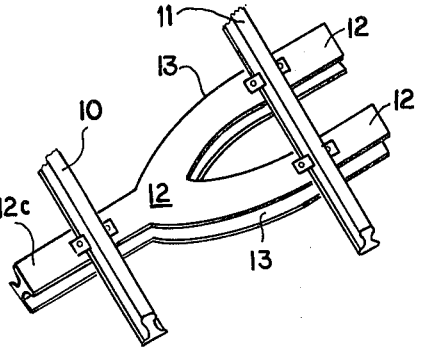
FIG.5
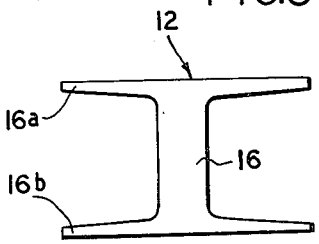
FIG.4
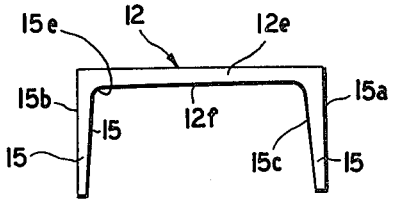

METHOD OF MANUFACTURING RAILWAY SLEEPERS

CROSS-REFERENCE TO RELATED APPLICATION

The present application is a continuation-in-part of U.S. patent application Ser. No. 870,883 filed Jan. 20, 1978, now abandoned.

FIELD OF THE INVENTION

My present invention relates to a method of manufacturing railway sleepers. More particularly, my invention relates to a railway roadbed assembly having a zig-zag sleeper network and made by a unique method.

BACKGROUND OF THE INVENTION

The development of engines capable of powering trains at speeds of over 250 km per hour has necessitated the improvement of railway roadbed assemblies to increase directional stability and resistance to lateral sliding and to more efficiently transfer loads to the track bed.

OBJECTS OF THE INVENTION

An object of my present invention is to provide a method of making a railway roadbed assembly with improved directional stability and sliding resistance and efficient load-transfer characteristics.

Another object of my present invention is to provide such a railway roadbed assembly which is easy to manufacture, lay and maintain.

Yet another object of my present invention is to provide a method of manufacturing sleepers to be used in forming such a roadbed assembly.

SUMMARY OF THE INVENTION

A railway roadbed assembly according to my present invention comprises a pair of spaced-apart rails overlying a multiplicity of step-shaped sleepers. Each sleeper has two straight end segments or portions interconnected by a middle portion inclined at obtuse angles with respect to the end segments, the sleepers being formed from steel sections. The end segments of each sleeper underlie a respective rail and are each joined to a juxtaposed end segment of an adjacent sleeper to form a generally zig-zag sleeper network underlying the two rails. Track clamps secure the end segments to flanges of the respective rail overlying same, the clamps each including a plate disposed between an end segment of a sleeper and the respective overlying rail. A rolled steel profile having at least one vertical web and a horizontal web extending below the sleeper network substantially parallel to the rails is fastened to the clamp plates by bolts traversing the sleepers, the vertical web being imbedded in a railway bed for anchoring the railway assembly against lateral displacement.

According to another feature of my present invention, the sleepers are formed from I-beam sections or profiles and a space or chamber formed between the joined end segments of adjacent sleepers is filled with a corrosion-resistant material such as concrete.

According to another feature of my present invention, each sleeper underlying a curve in the rails has end segments including with respect to each other an angle inversely proportional in magnitude to the curvature of the track.

According to yet another feature of my present invention, the clamps include a shock-absorbing resilient member juxtaposed to the plate for reducing noise. The railway bed in which the vertical web is disposed may be made of concrete.

Pursuant to another feature of my present invention, a method of forming a railway sleeper comprises the steps of folling a pair of steel profiles; heating the profiles, placing the profiles in spaced-apart parallel positions wherein the profiles have two juxtaposed end portions; pressing the juxtaposed end portions together while maintaining the separation of the other two ends; and welding the juxtaposed end portions to each other.

Pursuant to another feature of my present invention, the profiles are I-beams, the step of welding the end portions together including the welding of a steel plate to the upper flanges of the end portions. A space formed between the welded end portions may be filled with a corrosion-retarding material such as concrete.

BRIEF DESCRIPTION OF THE DRAWING

The above and other objects, features and advantages of my present invention will become more readily apparent from the following description, reference being made to the accompanying drawing in which:

FIG. 1 is a perspective view of a railway track structure provided with ties in accordance with my present invention;

FIG. 2 is a plan view of a tie whose arms are arcuately bent;

FIG. 3 is a perspective view of a tie showing a welded junction;

FIG. 4 is an end view illustrating a possible profile for the tie of FIG. 2 or FIG. 3;

FIG. 5 is a view similar to FIG. 4 illustrating another profile.

SPECIFIC DESCRIPTION

Figure 6:
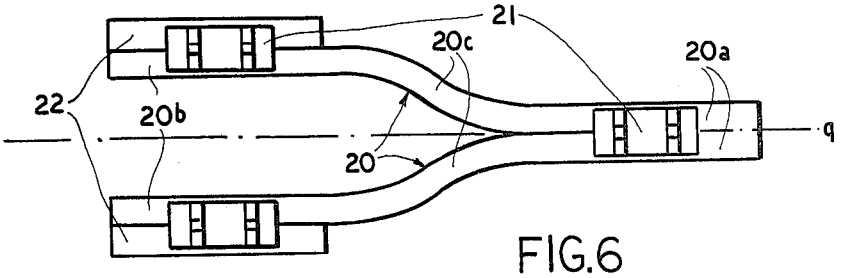
FIG. 6 is a plan view of a railway tie similar to the ties shown in FIGS. 2 and 3.

The track structure shown in FIGS. 1–3 of the drawing each comprise a pair of rails 10,11, mounted upon a sequence of sleepers, each of Y-construction and represented at 12, alternating sleepers 12 being turned in opposite directions, rotated with respect to one another in the horizontal plane through 180°.

The unitary sleepers 12 shown in FIG. 1 can be composed of reinforced concrete and comprise a pair of arms 12*a*, 12*b* and a shank 12*c* which are mutually parallel and rectilinear at least at the portions thereof upon which the rails are supported.

Each of the rails is held upon the arms and shanks of the sleepers by track clamps represented at 17 in FIG. 1.

More specifically, the arms 12*a* and 12*b* of the sleepers 12 shown in FIG. 1 are mutually parallel and extend from outwardly divergent branches 12*a'* and 12*b'*, respectively, which adjoin one another and the shank 12*c* at a junction 12*d*. The arms 12*a* and 12*b* have a length L which exceeds the length of the shank 12*c* represented at D and can be twice the length D so that the junction 12*d* of alternate sleepers lie to one side and another of a vertical median plane P between the rails.

The arms 12*a* and 12*b* have a spacing A which exceeds the width B of the shank 12*c* and hence the width C of these arms as measured along the rails. In practice the distance A may be 40 to 60 cm while the width B or C is 20 to 25 cm. The arms 12*a* and 12*b* and the shank 12*c* of each sleeper (FIG. 1) are of identical cross-section throughout its length.

Each Y-shaped sleeper is a unitary one-piece structure with considerable torsional stiffness resisting one-sided loading.

FIG. 2 shows that the sleeper 12 can consist of an I-beam construction with a profile corresponding to that shown in FIG. 5 and hence of steel. In this case, the arms 12*a* and 12*b*, in the regions in which they are not rectilinear, are arcuately bent from their junction with shank 12*c* with, for example, a radius of curvature of 500 mm to provide the arcuate portions represented at 13.

The sleeper of FIG. 3 is shown to be welded from three steel members along a V-shaped butt-welding seam 14 and the steel members are here composed of channel profiles such as shown in FIG. 4.

When the sleeper is to be used for a ballast-free right-of-way, the channel configuration of FIG. 4 is used with the outer surfaces 15*a* and 15*b* of the shanks of the U being perpendicular to the outer surface 12*e* of the web of the U. The inner surfaces 15*c* and 15*d* of the shanks can adjoin the inner surface 12*f* of the bight along radiused portions 15*e* and can diverge outwardly so that the shanks 15 are tapered downwardly.

When, however, the sleeper is to be used with a ballasted right-of-way, the I-beam configuration shown in FIG. 5 is preferred. In this case, the structure includes a relatively thick vertical web 16 whose upper and lower flanges are tapered outwardly. The flanges can be relatively wide and thus form a good resting surface upon the ballast with high transverse-shifting resistance. In its vertical plane, the double-T profile has a high bending moment while it is more readily bendable in its horizontal plane.

In FIG. 6 I have illustrated yet another embodiment of a Y-shaped railway tie according to my present invention. Two step-shaped sleeper elements 20 symmetric with respect to each other about a central axis g have rectilinear end portions 20*a*, 20*b* interconnected by arcuate middle portions 20*c*. At end portions 20*a* sleeper elements 20 are welded to a rib plate 21, while end portions 20*b* are welded to plates 21 in turn welded to straight steel profile sections 22. Alternatively, sleeper elements 20 and sections 22 may be joined to plates 21 by a multiplicity of bolts. If a railway using the sleeper illustrated in FIG. 6 is laid on a roadbed together with a ballast material, it is advantageous that sleeper elements be formed from I-beam profiles. If, on the other hand, no ballast is used, it is advantageous to form sleeper elements 20 from inverted channels. I-beam profiles utilized for forming sleeper elements 20 may have a flange breadth and thickness of 100 mm and 9–10 mm, respectively, a connecting web height of 98–100 mm, and a web thickness of 6–7 mm. Sleeper elements may have a length of 230 cm and beam sections 22 a length of 88 cm. A plurality of Y-shaped sleepers are laid side-by-side as illustrated in FIG. 1.

Figure 7:
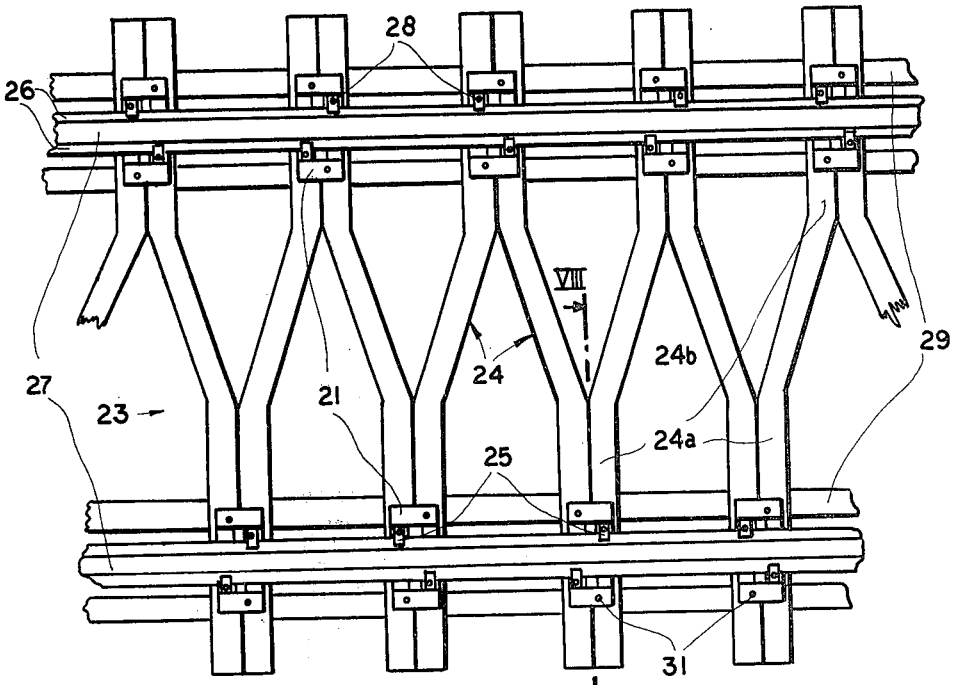
FIG. 7 is a plan view of a modified railway roadbed assembly according to my present invention.

In FIG. 7 I have shown a zig-zag sleeper network 23 formed from step-shaped sleeper elements 24 according to my present invention. Each sleeper element 24 comprises two straight end segments 24*a* interconnected by a middle segment 24*b* inclined at obtuse angles with respect to the end segments. Adjacent sleeper elements 24 are joined to each other at a pair of juxtaposed end segments 24*a*, the middle segments of the adjacent sleeper elements 24 being inclined in opposite directions. The sleeper elements are welded to each other by plates 21.

Figure 8:
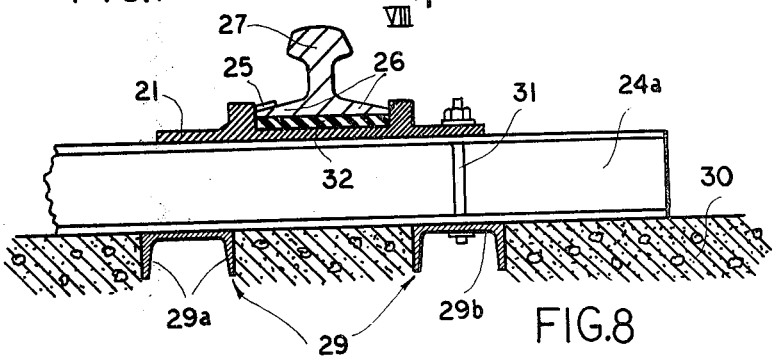
FIG. 8 is a partial cross-section taken along the line VIII—VIII in FIG. 7.
Figure 13:
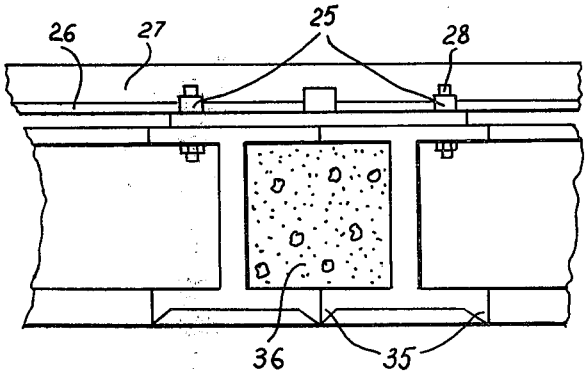
FIG. 13 is an end view of the tie shown in FIG. 6.

As illustrated in FIGS. 7,8 and 13, track clamps 25 engaging flanges 26 of a pair of spaced-apart rails 27 are fastened to plates 21 and sleeper elements 24 by means of respective bolts 28, thereby securing rails 27 to sleeper network 23. FIGS. 7 and 8 further illustrate two pairs of channel profiles 29 extending parallel to rails 27. Vertical webs 29*a* of channels 29 are embedded in a railway or track bed 30 for preventing lateral displacement of railway assembly 23, 27, an upper horizontal web 29*b* of each channel 29 being secured to plates 21 by bolts 31 traversing a sleeper end segment 24*a*. Channels 29 are especially advantageous if sleeper elements 24 are formed from I-beams and if no ballast is used. As shown in FIG. 8, track bed 30 may be made of poured concrete.

The railway roadbed assembly illustrated in FIGS. 7 and 8 is constructed by first laying the channels 29, either in the ground or in a concrete track bed. Bolts 31 are then welded to channels 29, sleeper elements 24 and plates 21 aligned with and fastened to channels 29 via bolts 31, and rails 27 clamped to plates and sleeper elements 24 by track clamps 25. Shock-absorbing resilient material 32 may be inserted between plates 21 and rails 27 for reducing noise generated upon the passing of a train.

Figure 12:
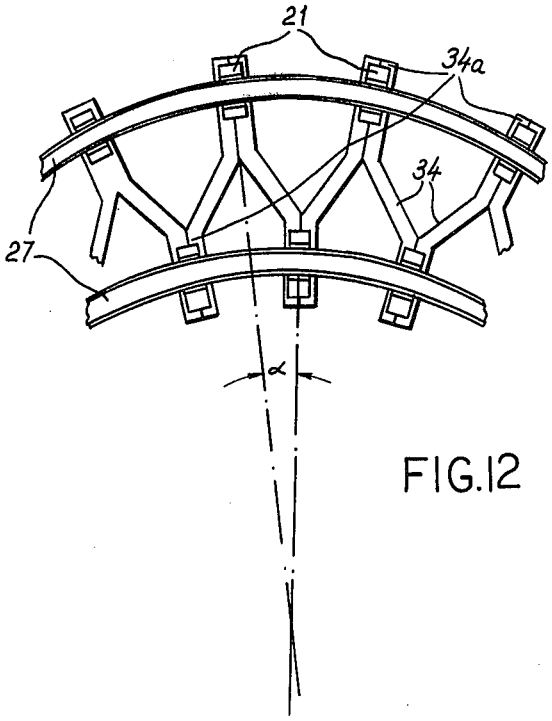
FIG. 12 is an exaggerated plan view of a curve in a railway roadbed assembly according to my present invention.

As illustrated in FIG. 12 sleeper elements 34 underlying a curve 33 of rails 27 have preformed end segments 34*a* inclined with respect to each other at an angle $\alpha$ inversely proportional to the radius of curvature of the track curve 33. It is to be noted that adjacent sleeper elements 24 or 34 may be spaced apart rather than mutually engaging each other at end portions 24*a* or 34*a*, thereby facilitating the bolting of plates 21 directly to a roadbed surface.

As heretofore described, a railway roadbed assembly formed from I-beam sleeper elements 24 and 34 may be anchored against lateral displacement by channel profiles 29 lying below sleeper network 23 and embedded in the ground or in a concrete tack bed. As shown in FIG. 13, an alternative solution includes the formation of wedge-shaped beads 35 on the lower flange of the I-beam sections, the grasping of a roadbed surface by the beads being improved by filling an interbeam space 36 between end segments 24*a*, 34*a* with blast-furnace sand, gravel, asphalt, concrete, etc. or with a combination of materials. In addition to increasing the weight of sleeper elements 24, 34, filling spaces or chamber 36 will also serve to inhibit corrosion of the metal.

Figure 9:
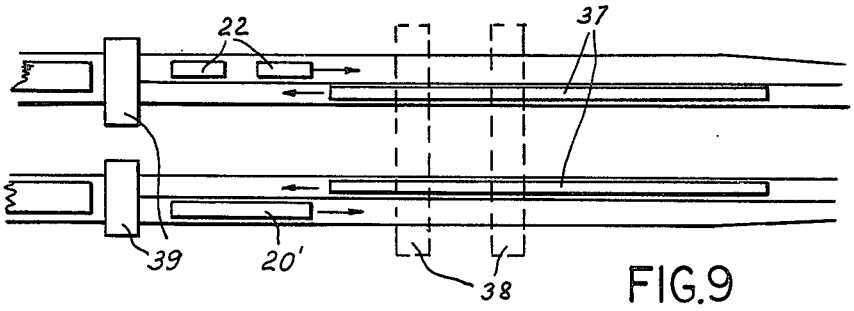
FIG. 9 is a schematic diagram illustrating the cutting of steel sections into bars for forming the tie shown in FIG. 6.
Figure 10:
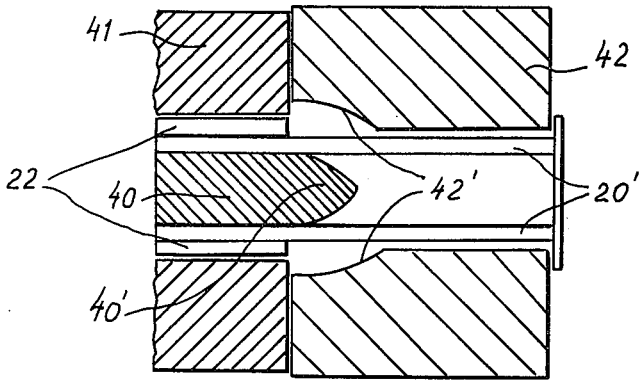
FIG. 10 is a schematic cross-sectional view of a press forge for forming the tie shown in FIG. 6.
Figure 11:
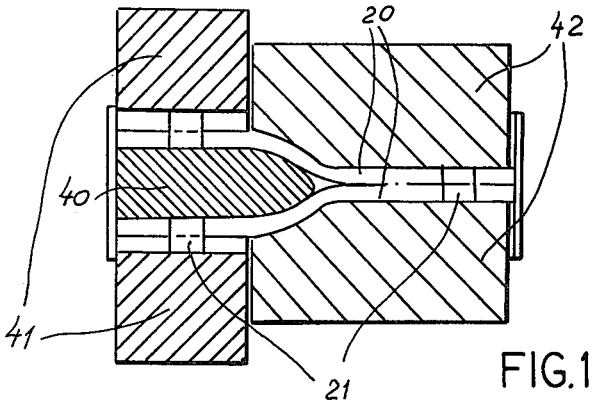
FIG. 11 is a view similar to FIG. 10 showing an operational phase of the press forge.

It will now be convenient to describe a method of forming according to my present invention, the Y-shaped tie shown in FIG. 6. As illustrated in FIG. 9, I-beam sections 37 are fed from a rolling mill (not shown) over a roller path 38 to a station 39 where profile sections 22 and 20' are cut, profile 20' having the same length as sleeper element 20 (FIG. 6). Profiles 20' and 22 are then conveyed to an assembly comprising a press block 40 having an arcuate extremity 40', a pair of clamping blocks 41 and a pair of press dies 42 having arcuate inner surfaces 42' laterally disposed with respect to extremity 40', as shown in FIG. 10. Upon the alignment of profiles 20' along block 40 and the juxtaposition of profile sections 22 to end portions of respective profiles 20', blocks 41 are displaced laterally to clamp profiles 20' and 22 against block 40. Press dies 42 are then moved laterally, bending profiles 20' along arcuate surfaces of extremity 40' to form sleeper elements 20. As illustrated in FIG. 11, plates 21 are then placed over sleeper elements 20 and profile sections 22 and welded thereto to form a unitary Y-shaped tie. While the tie is still in the press assembly 40, 41, 42, perforations may be made in plates 21 and profiles 20,22 for bolts 28,31 (FIGS. 7,8,13). If necessary profile sections 20' and 22 may be heated prior to press forming by assembly 40,41,42. After cooling of the sleepers, a weight-increasing corrosion-retarding material such as asphalt or concrete may be inserted in interbeam spaces, as heretofore described with respect to FIG. 13.

The above-described method of manufacturing the Y-shaped sleeper unit shown in FIG. 6 may also be used in the formation of the zig-zag sleeper network shown in FIG. 7. As an alternative to being formed from step-shaped sleeper elements 24, network 23 may be constructed from Y-shaped sleeper units similar to those heretofore described with reference to FIG. 1. Rather than alternating in the direction of their alignment, however, all the Y-shaped sleepers used to construct network 23 will be laid in the same direction. It is clear that profile sections 22 would be omitted entirely in the process of manufacturing Y-shaped sleeper elements for utilization in the formation of zig-zag sleeper network 23; it is also clear that press-block extremity 40' (FIGS. 10 and 11) may be triangular in shape to form angular Y-sleepers having rectilinear rather than arcuate middle segments.

I claim:

1. A method of forming a railway sleeper comprising the steps of:

rolling a pair of steel profiles in the form of I-beams having upper and lower flanges and webs connecting said flanges;

heating said I-beams;

placing said I-beams in spaced-apart parallel positions so that said profiles have corresponding flanges in coplanar relationship and oppositely juxtaposed end portions in mutually parallel relationship;

pressing corresponding end portions together in a heated condition thereof to permanently deform the end portions which are pressed together, thereby causing flanges of the I-beams to abut, while maintaining the separation of the other two end portions of said profiles; and welding the end portions which have been pressed together to one another along the abutting flanges at least in part by welding a plate to two abutting flanges of the pressed-together end portions.

2. The method defined in claim 1, further comprising the step of filling a space between the webs and flanges of the pressed-together end portions with a corrosion-retarding material.

3. The method defined in claim 2 wherein said corrosion-retarding material is concrete.

* * * * *